United States Patent [19]

Boot et al.

[11] Patent Number: 4,880,157

[45] Date of Patent: Nov. 14, 1989

[54] CAPACITY CONTROL FOR INTEGRATED FURNACE

[75] Inventors: Jay L. Boot, Manlius; Chester D. Ripka, East Syracuse; Ian M. Shapiro, Fayetteville, all of N.Y.

[73] Assignee: Carrier Corporation, Syracuse, N.Y.

[21] Appl. No.: 218,411

[22] Filed: Jul. 11, 1988

Related U.S. Application Data

[63] Continuation of Ser. No. 17,302, Feb. 20, 1987, abandoned.

[51] Int. Cl.[4] ..... F22B 35/00

[52] U.S. Cl. ..... 236/25 R; 236/23; 237/19

[58] Field of Search ..... 236/25 R, 25 A, 23, 236/24, 46 F, 46 R; 237/19, 8 R

[56] References Cited

U.S. PATENT DOCUMENTS

| | | | |
|---|---|---|---|
| 3,815,813 | 6/1974 | Charron et al. | 236/23 |
| 4,562,956 | 1/1986 | Check | 237/19 X |
| 4,585,165 | 4/1986 | Iversen | 237/8 R |

FOREIGN PATENT DOCUMENTS

| | | | |
|---|---|---|---|
| 2414224 | 8/1979 | France | 237/19 |

*Primary Examiner*—Harry B. Tanner
*Attorney, Agent, or Firm*—Robert H. Kelly

[57] ABSTRACT

A method and control system are disclosed for operating an integrated heating system for space heating and tankless domestic hot water heating utilizing an infrared burner module and heat exchanger coil. When the system is below 100% capacity, the burner is pulsed using a constant pulse period and varying the on-pulse width to vary capacity, or where a minimum on-pulse width is maintained the off-pulse width is varied to vary capacity.

2 Claims, 4 Drawing Sheets

CAPACITY CONTROL FOR INTEGRATED FURNACE

This application is a continuation of application Ser. No. 017,302 filed Feb. 20, 1987 abandoned.

BACKGROUND OF THE INVENTION

This invention relates generally to a control for an integrated heating system and more particularly, to a modulated control for an integrated heating system for space heating and tankless domestic hot water heating which utilizes an infrared burner module and a heat exchanger coil.

In heating systems for homes and commercial buildings, central furnaces to heat a space all operate on the same general principle. Air for a space to be heated circulates through a closed system generally comprising sheet metal ductwork, and is heated either as it passes through a heat exchanger in contact with a burning fuel, or as it passes in contact with a secondary fluid which has been heated by a burning fuel. Since burning the fuel results in the production of noxious combustion gases having exhaust temperatures which can exceed 500° F., it is necessary to exhaust the combustion gases through a chimney or flue to the atmosphere. These systems are relatively inefficient as evidenced by the high exhaust temperatures of the flue gases, and costly due to the construction of the necessary flue or chimney.

Indirect fired furnaces, ones in which the air being heated is not contacted directly by the combustion gases generated, are generally used in both forced air systems and hydronic systems.

A forced air system consists primarily of a heat exchanger having combustion chambers arranged in relation to the flow of air to be heated such that fuel is introduced at one end of a chamber where a flame causes heat to be generated. The heat passes through a series of internal baffles before exiting through the other end of the combustion chamber into the flue or chimney. Simultaneously, circulated space air passes around the outside of the heat exchangers to absorb heat through conduction and convection.

A hydronic system consists primarily of a firebox having a heat exchanger therein. The heat exchanger is in a closed loop for continuously circulating water, a water glycol solution or other suitable heat exchange medium from the heat exchanger to a remote radiator in the space to be heated. However, this system is also relatively inefficient and expensive due to the combustion gas temperatures at the outlet of the firebox and the cost of the chimney.

Thus, the inefficient home heating system is generally the largest consumer of energy with the domestic hot water system being the second largest consumer of energy. In supplying domestic hot water for homes and commercial buildings, potable hot water systems with ordinary glass-lined, hot water storage tanks are generally used. It is common for these systems to have an enclosed water tank in which are spiraled coils of tubing through which flows the water to be heated. At the lowermost portion of the tank there is normally a burner whose heat is allowed to pass over the coils, thereby heating the water in the tank for use within the home or building. Again, as in the space heating systems for homes and buildings, the heat which is not transferred to the heat exchanger during demand "on-time" and also during standby "off-time", is exhausted at the top of the tank into a flue or chimney to the atmosphere as well as being lost through the tank jacket. Thus, a domestic hot water system is also inefficient because a great portion of the heat is lost directly up the chimney to the atmosphere.

Because of the rising costs of energy, the incentives to conserve energy are increasing. Consequently, there is currently considerable interest in recovering energy, such as waste heat from combustion heaters which is usually injected into the atmosphere without recovery.

In an attempt to reclaim reject heat, heat exchanger coils have been installed in the flue of a furnace to transfer some of the waste heat to domestic hot water heaters, thus recovering some usually wasted heat.

However, a drawback to conserving energy by reclaiming reject heat from a furnace for use by domestic hot water heaters is that both systems are controlled independently, and the energy saved is limited by the temperature of the water in the hot water tank for potable use and typically maintained between 120° F. and 160° F., the average being at or above the flue gas condensing temperature therefore limiting the efficiency of recovery at or up to a maximum threshold of the product of 88% to 90%. The necessity for dual control schemes for semi-integrated furnaces and hot water heaters is due to the blue flame burners used by both systems. In semi-integrated appliances dual controls are necessary because there is not true integration of a common heating loop that provides capacity at different required temperatures for both heating and hot water. This requires a rapid on-off response with modulation of input and flow controls and blue-flame burners by nature are not capable of controlling modulation this way effectively and therefore are limited to operation at some fraction of full input during continuous operation. Capacity of these burners cannot be reduced as demand for hot water is reduced but are fired at full capacity under all operating conditions.

Thus, there is a clear need for an integral liquid-backed gas-fired heating and hot water system having a modular design and a capacity control scheme for the integrated system.

SUMMARY OF THE INVENTION

It is an object of the present invention to provide a control system for an integrated space heating and tankless hot water heating system.

It is another object of the present invention to provide a control system for an integrated heating system having a liquid-backed gas-fired heating module with a radiant burner which will control the heat output of the infrared burner to match the rate at which energy is required for either space heating or domestic water heating, or both.

A further object of the present invention is to provide a control system for an integrated heating system having a radiant burner which more efficiently controls the capacity of the heating system.

These and other objects of the present invention are attained by providing a capacity modulated control for a heating system for heating a space in a building and domestic hot water. The heating system having a liquid-backed heating module with a quick response and a tankless domestic hot water system, permits maximum radiant heat transfer capacity to be reached quickly, thus allowing pulsing of the burner to maintain heating module liquid temperatures within desired limits.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings forming a part of the specification, and in which reference numerals shown in the drawings designate like or corresponding parts throughout the same.

DESCRIPTION OF THE PREFERRED EMBODIMENT

Figure 1:
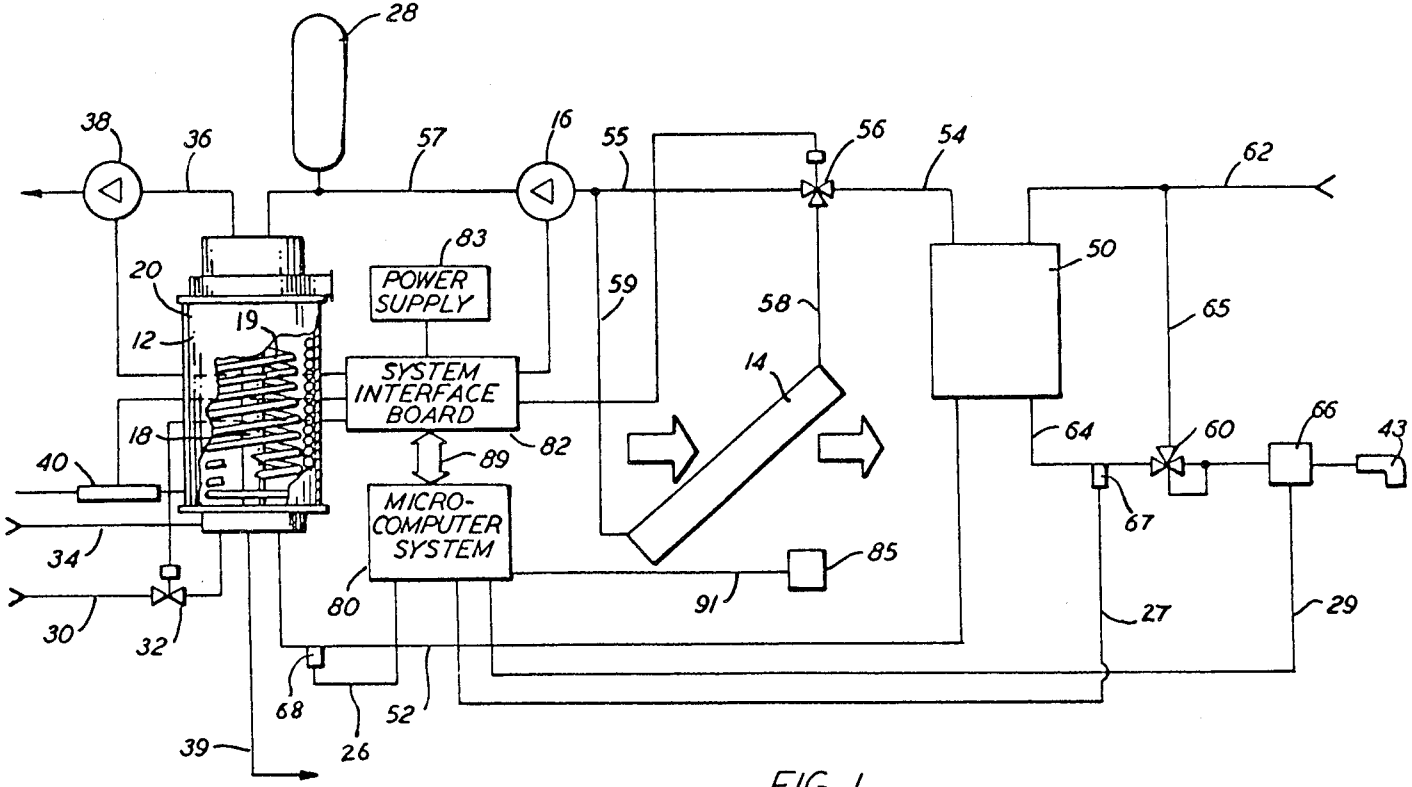
FIG. 1 is a schematic diagram of an integrated space heating and hot water system embodying the control of the present invention.

Referring now to FIG. 1 there may be seen a schematic view of residential heating system 10 using a liquid-backed heating module 12 for supplying energy to a series fluid loop including a tube-in-tube heat exchanger 50 and a fan coil 14. The fluid loop further includes a liquid pump 16 for circulating fluid therethrough and an expansion tank 28 to provide for the volume increase of the heated fluid and for dampening any pressure surges in the fluid loop. The fluid loop arrangement consists of discharge pipe 52 which extracts hot fluid from heating module 12 on demand. The heated fluid flows through the tube-in-tube heat exchanger 50 of conventional construction. The fluid then flows through pipe 54 and through a three-way diverting valve 56. In a first position the three-way valve 56 allows the fluid to flow directly to the liquid pump 16 through pipe 55 and back to the heating module 12 through pipe 57. In a second position the three-way valve 56 allows the fluid in the loop to flow through pipe 58 into fan coil 14 and through pipe 59 back to the suction of liquid pump 16.

Further, as shown, the domestic hot water loop includes cold water inlet pipe 62 connected to the inlet of tube-in-tube heat exchanger 50 and outlet pipe 64 which discharges hot domestic water to tap 43 after passing through flow switch 66. A mixing valve 60 connects pipe 64 to bypass pipe 65. Mixing valve 60 is preferably a temperature responsive valve which mixes the hot water flowing through the heat exchanger 50 and the cold water flowing through the bypass pipe 65 to ensure that the hot water flowing from the tap 43 is at a desired set temperature.

As further illustrated, the heating module 12 includes a gas line 30 having a regulator 32 for supplying fuel to the module. Further, air is supplied to the module through line 34. The air/fuel mixture is ignited and burned on the infrared burner 18 located centrally within housing 20. The air/fuel is 100% premixed, thus, no secondary combustion occurs. The heat exchange means 19 is located in spaced relation to the infrared burner 18 to receive heat from the infrared burner. The heat exchange means is generally in the form of a helical coil and has the fluid flowing therethrough which absorbs heat from the infrared burner, which in turn transfers this heat to the domestic hot water and the space to be heated.

Further, FIG. 1 illustrates the integrated domestic hot water/space heating system having a control system in accordance with the principles of the present invention. This control system comprises a :microcomputer system 80, a system interface board 82, and a power supply 83. The microcomputer system 80 may be any device, or combination of devices, suitable for receiving input signals, for processing the received input signals according to preprogrammed procedures, and for generating control signals in response to the processed input signals. The control signals generated by the microcomputer system 80 are supplied to control devices which control operation of the integrated heating system in response to control signals provided to the control devices from the microcomputer system 80.

As shown in FIG. 1, the system interface board 82 is connected by ribbon cable 89 to the microcomputer system 80. The system interface board 82 includes switching devices for controlling electrical power flow from the main power supply 83 to three-way valve 56, liquid pump 16, inducer blower 38, gas valve 32, and ignition device 40. Preferably, the switching devices are electronic components, such as relays, which are controlled in response to control signals from the microcomputer system 80 which are supplied through the ribbon cable 89 to the electronic components on the system interface board 82.

Figure 2:
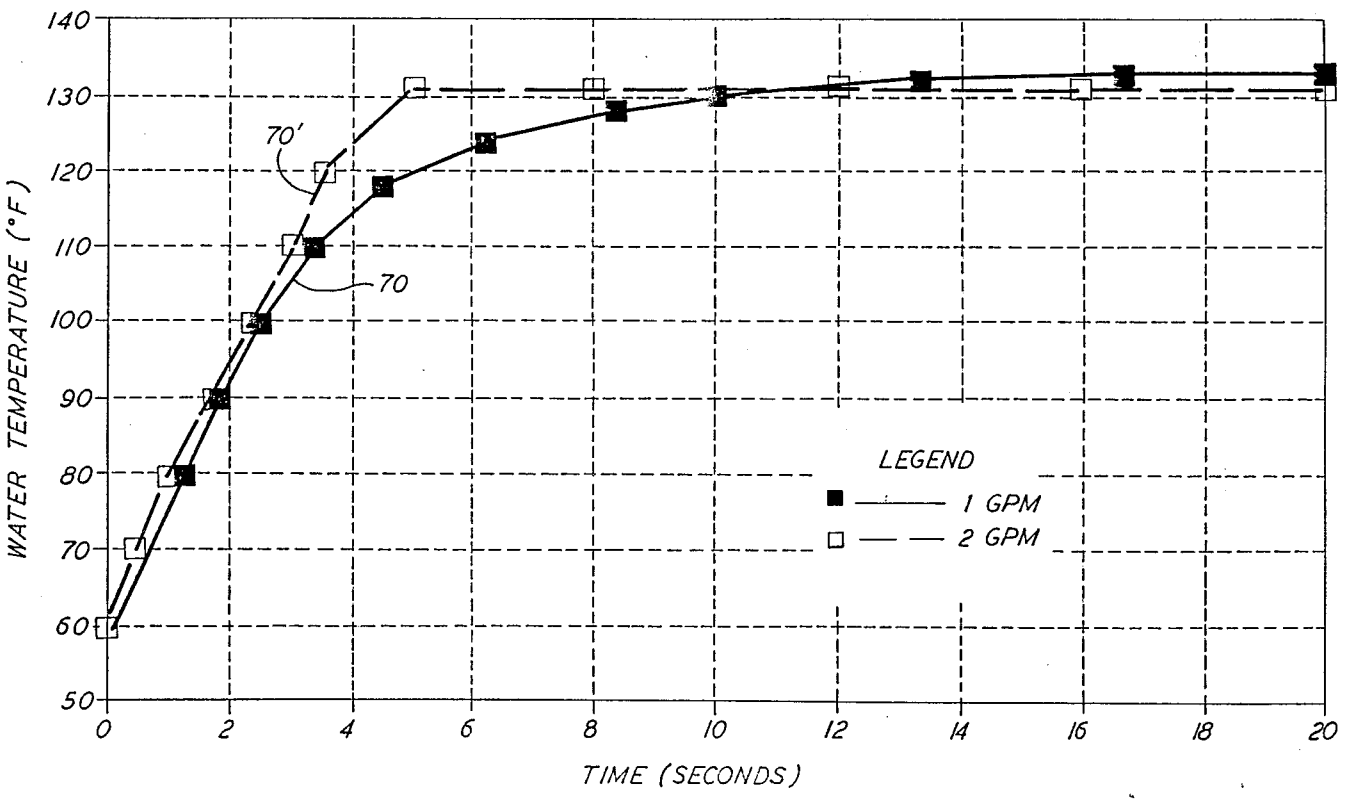
FIG. 2 is a graph of the transient domestic hot water temperature response to a call for domestic hot water in an integrated space heating and domestic hot water system.
Figure 3:
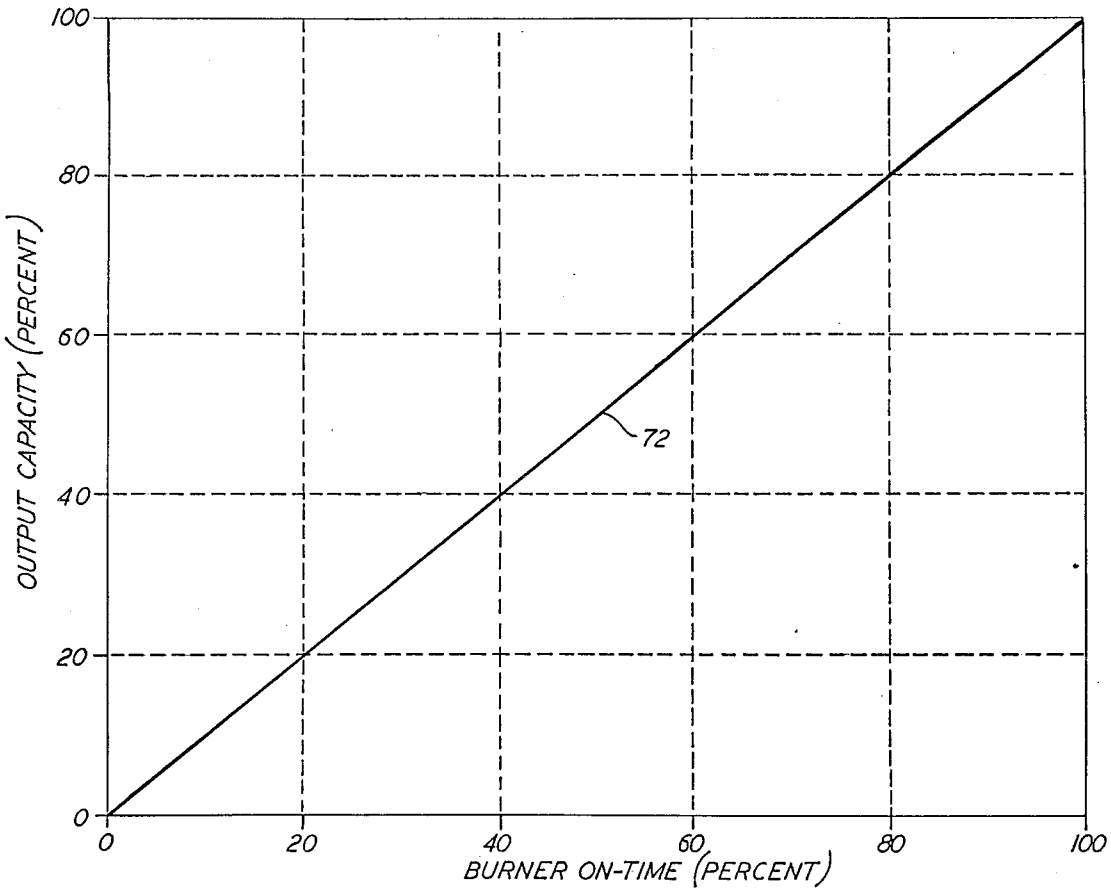
FIG. 3 is a graph of the percentage output capacity versus the percentage of the on time of the pulse period of an integrated space heating and hot water system embodying the control of the present invention.
Figure 4A:
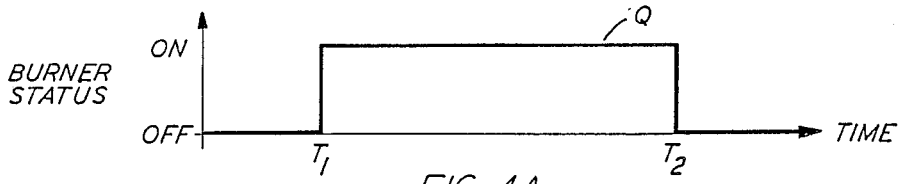
FIG. 4 A–E is a comparison of full capacity control with the pulsed control of the present invention.
Figure 4B:
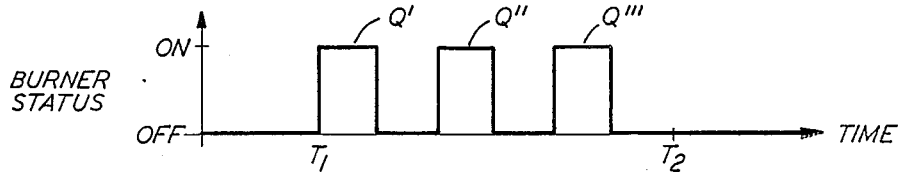
Figure 4C:
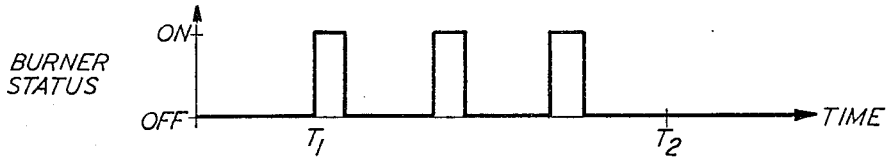
Figure 4D:
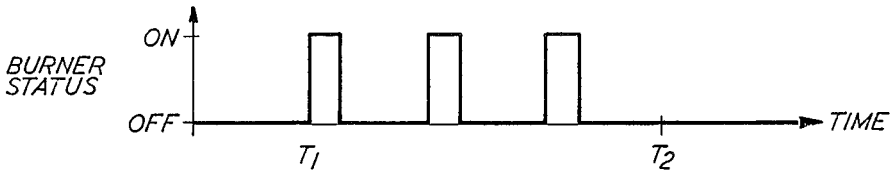
Figure 4E:
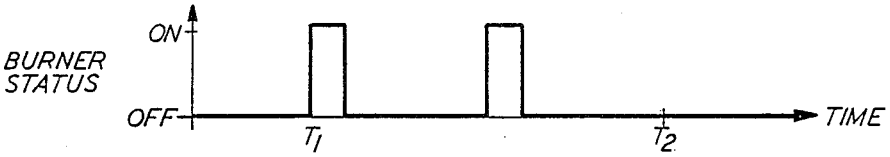

According to the present invention, the control system determines when to operate the integrated heating system to satisfy the need for space heat and/or domestic hot water. For the purpose of this disclosure "pulsing" shall mean turning the infrared burner on and off repeatedly while the inducer fan runs continuously during the pulse period. Further, "pulse period" shall mean the sum of one "on" and one "off" pulse. The infrared burner 18 of the module 12 has the unique feature that it has a quick response time which allows the maximum radiant heat transfer capacity to be reached quickly, e.g. in about one second, thus transferring its entire output energy to the liquid loop in a short period. More specifically, according to the present invention the temperature of the space to be heated is sensed by a thermostat 85 and a signal indicative of this temperature is provided by way of electrical line 91 to the microcomputer system 80. Further, the flow of domestic hot water flowing through tap 43 is sensed by flow switch 66 and a signal indicative of this flow is provided by way of electrical line 29 to the microcomputer system 80. Still further, the temperature of the series fluid loop is sensed by temperature sensor 68 at the outlet of the heat exchange means 19 and a signal indicative of this temperature is provided by way of an electrical line 26 to the microcomputer system 80. Also, the temperature of the domestic hot water loop is sensed by temperature sensor 67 and a signal indicative of this temperature is provided way of electrical line 27 to the microcomputer system 80. Turning now to FIGS. 2 and 3, there is exemplified the quick response time which allows continuous use of domestic hot water and the output capacity of the infrared burner as a percentage of "on" time.

In FIG. 2, curve 70 indicates the water temperature with respect to time for a one GPM flow through tap 43 while curve 70' indicates the temperature per time for a 2 GPM flow.

In FIG. 3, the output capacity of the infrared burner 18 is shown as a percentage of the burner on time.

Turning now to FIGS. 4 A–E, there is shown the output capacity of a burner from a first time ($T_1$) at which demand was initiated and a second time ($T_2$) at which time demand was terminated. Thus, FIG. 4A shows a burner at 100% capacity, Q, from initiation time to termination time, without modulation. Specifically, FIG. 4B shows a 50% capacity, 0.05Q, made up of three normally equal capacities Q', Q'' and Q'' where $Q'+Q''+Q'''=0.5Q$. In FIG. 4C, there is shown a burner at capacity and 25% capacity, respectively, using pulse width capacity modulation of the present invention. Accordingly, the pulse period is maintained constant while the "on" pulse of the burner is modulated to vary the capacity. Moreover, as shown in FIGS. 4 D–E the frequency of the pulse period is varied to obtain a 25% capacity and 17% capacity respectively. Thus, under the frequency modulation scheme a minimum on-pulse width is maintained and the off-pulse width is changed to vary the capacity. The frequency modulation of FIGS. 4 D–E may be necessary in those circumstances where a minimum on-pulse width is required by a code agency.

According to the present invention, each time it is desired to energize the heating module, for example, when the flow sensor 66 detects flow through tap 43, the microcomputer system 80 provides another control signal by way of the ribbon cable 89 to the appropriate switching device on the system interface board 82 to supply power from the power supply 83 through the system interface board 82 to the ignition device 40. The microcomputer system determines the domestic hot water demand as a function of the temperature of the closed loop liquid leaving the module 12 and adjusts the pulse period of the infrared burner so that the domestic hot water is maintained at a desired temperature. Moreover, if the demand at the tap 43 is decreased then the on-pulse may decrease from that shown in FIG. 4B to that shown in FIG. 4C.

While the preferred embodiments of the present invention have been depicted and described, it will be appreciated by those skilled in the art that many modifications, substitutions, and changes may be made thereto without departing from the true spirit and scope of the invention. For example, flow sensor 66 could be located in line 62 or 64.

What is claimed is:

1. A capacity control system for an integrated heating system for space and domestic hot water heating having a burner, a coil for receiving heat from the burner, and a primary fluid loop connected to the coil, the primary fluid loop having a heat exchanger for transferring heat to a space and a tankless tube-in-tube heat exchanger receiving heat from the primary loop for transferring heat to a secondary fluid loop of a domestic hot water system, the control system comprising:

a burner flame control means for controlling the pulsing of the repeated ignition and combustion termination of the burner wherein the burner includes an infrared burner which allows maximum radiant heat transfer capacity to the coil to be reached quickly, said burner flame control means including a flow switch for detecting absolute fluid flow of the domestic hot water in the secondary fluid loop of the domestic hot water system and providing a first "on" signal to a microprocessor means indicative of the presence of hot water flow in the secondary fluid loop of the domestic hot water system, and a temperature sensor means for detecting the temperature of the fluid at an outlet of the coil receiving heat from the burner and providing a second signal to the microprocessor means indicative of the temperature of the fluid in the primary fluid loop whereby said microprocessor provides an output signal to control the pulsing of said repeated ignition and combustion termination of the burner so that the fluid in the loop, wherein the fluid in the primary loop flows in series through the primary loop coil, the heat exchanger, and the tube-in-tube heat exchanger, is maintained at a desired temperatures.

2. A capacity control system as set forth in claim 1 wherein the domestic hot water system further includes a thermal mixing valve responsive to the desired temperature of the domestic hot water in the hot water loop to control the domestic hot water temperature at or below the desired temperature and said flow switch is located between the outlet of the tube-in-tube heat exchanger and a hot water tap in the hot water loop of the hot water system and provides an "on" or "off" signal.

* * * * *